US006651562B2

(12) United States Patent
Jader

(10) Patent No.: US 6,651,562 B2
(45) Date of Patent: Nov. 25, 2003

(54) DEVICE FOR ADJUSTING A PRINTING PRESS FRAME

(75) Inventor: Lennardt Jader, Strande/Freidorf (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/231,858

(22) Filed: Aug. 30, 2002

(65) Prior Publication Data

US 2003/0041760 A1 Mar. 6, 2003

(30) Foreign Application Priority Data

Sep. 5, 2001 (DE) ..... 101 43 563

(51) Int. Cl.[7] ..... B41F 21/00
(52) U.S. Cl. ..... 101/481; 101/480; 101/126
(58) Field of Search ..... 101/480, 481, 101/126

(56) References Cited

U.S. PATENT DOCUMENTS 3,610,148 A * 10/1971 Penaluna ..... 101/269
3,688,690 A * 9/1972 Guglielmo ..... 101/35
4,079,671 A * 3/1978 Dubuit ..... 101/124
4,610,200 A * 9/1986 Metso ..... 101/126
4,907,505 A * 3/1990 Ericsson et al. ..... 101/114
5,176,078 A * 1/1993 Homma et al. ..... 101/126
6,352,025 B1 * 3/2002 Neiconi et al. ..... 101/126

FOREIGN PATENT DOCUMENTS

DE 26 44 479 A1 4/1977 ..... B41F/15/10
GB 1 524 159 9/1978 ..... B41F/15/02

* cited by examiner

*Primary Examiner*—Ren Yan
*Assistant Examiner*—Jill E Culler
(74) *Attorney, Agent, or Firm*—Lawrence P. Kessler

(57) ABSTRACT

A device for adjusting a frame of a printing press carrying a conveyor belt relevant to printing modules in the three-dimensional axial directions. At least a First guide is provided on the frame for guiding a plate arranged on the frame in a horizontal direction x lengthwise to the frame by a first guiding component for adjusting the frame in the appropriate direction. Second guides are provided in a vertical direction y to the frame, on which two movable guiding components are positioned, and between the two guiding components, a third guiding component is arranged, which can be moved to the third guides on the second guiding components in the direction z transverse to a substantially horizontal plane of the frame.

3 Claims, 2 Drawing Sheets

DEVICE FOR ADJUSTING A PRINTING PRESS FRAME

FIELD OF THE INVENTION

This invention relates in general to adjusting the frame of a printing press, and more particularly to adjusting a printing press frame carrying a conveyor belt with respect to printing modules.

BACKGROUND OF THE INVENTION

In printing presses, transporting frames are provided on which movable conveyor belts are mounted. Printing stock is transported on the conveyor belts, and toner images are applied to the printing stock by the printing modules arranged close to the moving conveyor belts. The exact alignment of the printing drums of the respective printing modules with the printing stock on the conveyor belts is of crucial importance in this context. It is important that the narrow contact surface of the printing drum on the printing stock, which is also described as nip Or compression zone, is positioned with great precision on the printing stock. Shifting of the nip leads to printing errors on the printing stock, as can easily be understood.

On the subject of register control, the state of the art proposes a great number of solutions that basically concern the control of the register during the run of the printing press. However, with respect to the conveyor belt or printing stock, the nip may already be misaligned before the printing operation. The register controls for controlling the registerability in the direction of movement of conveyor belt, and transversely to the direction of movement of the conveyor belt somewhat change the speed of the conveyor belt, or the speed of the printing drum accordingly in the event of a misalignment in the direction of movement of the conveyor belt In the event of a misalignment transverse to the direction of movement of the conveyor belt, the axial position with respect to the printing drums is somewhat altered.

Misalignments are corrected to a certain extent, but a misalignment of the height of the printing drum with respect to the conveyor belt, i.e., the distance between the printing drum and the conveyor belt or printing stock or the nip pressure between them, is not controlled by the register controls. Furthermore, there are mechanical devices that adjust the frame to the conveyor belt in the direction of the belt path and in the direction transverse to the belt path prior to the printing process, in order to achieve an optimal alignment of the frame with the printing drums for the first time or to re-establish it after a certain operating period of the printing press and in order to prevent a misalignment or a distortion of the frame. These devices include costly adjustment structures.

SUMMARY OF TIE INVENTION

This invention is to provide a simple device for adjusting a printing module of a printing press with respect to the frame of the printing press, and thus to the printing stock-carrying conveyor belt. A device is provided for adjusting a frame of a printing press carrying a conveyor belt with respect to the printing modules, in which at least one of the first guides on the frame for guiding a plate arranged on the frame in a horizontal direction x lengthwise to the frame by a first guiding component for adjusting the frame in the appropriate direction. Vertical to the plate, two walls are arranged parallel to each other that have two guides in the vertical direction y to the frame which has two movable guiding components. Between the two guiding components, a third guiding component is arranged, which can be moved to the third guides positioned on the second guiding components in the direction z transverse to the frame.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
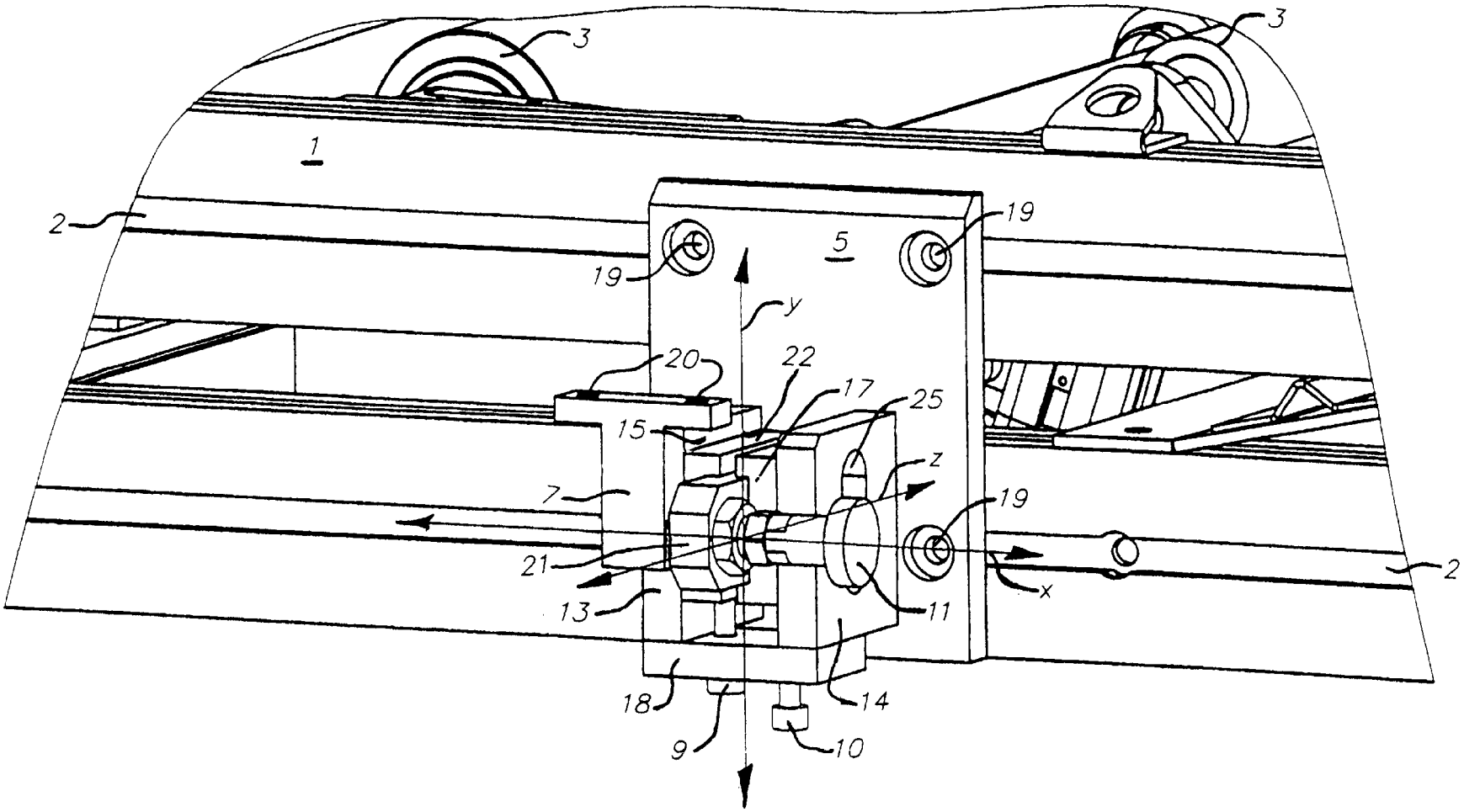
FIG. 1 is a view, in perspective of the printing press frame adjusting mechanism, according to this invention.

Referring now to the accompanying drawings, FIG. 1 illustrates part of a perspective view of a frame 1 of a printing press. Mounted on the frame 1 are rollers 3 on which a continuous conveyor belt or web lies and which conveys paper sheets through the printing press. It is extremely important that the conveyor belt is in the proper position, with reference to the printing drums (not shown), positioned on top of the conveyor belt, the printing drums forming toner images for transfer to printing stock (paper sheets) carried by the conveyor belt. At least one horizontal first guide 2 extends to the plate 5; two horizontal first guides 2 are illustrated in FIG. 1.

Figure 2:
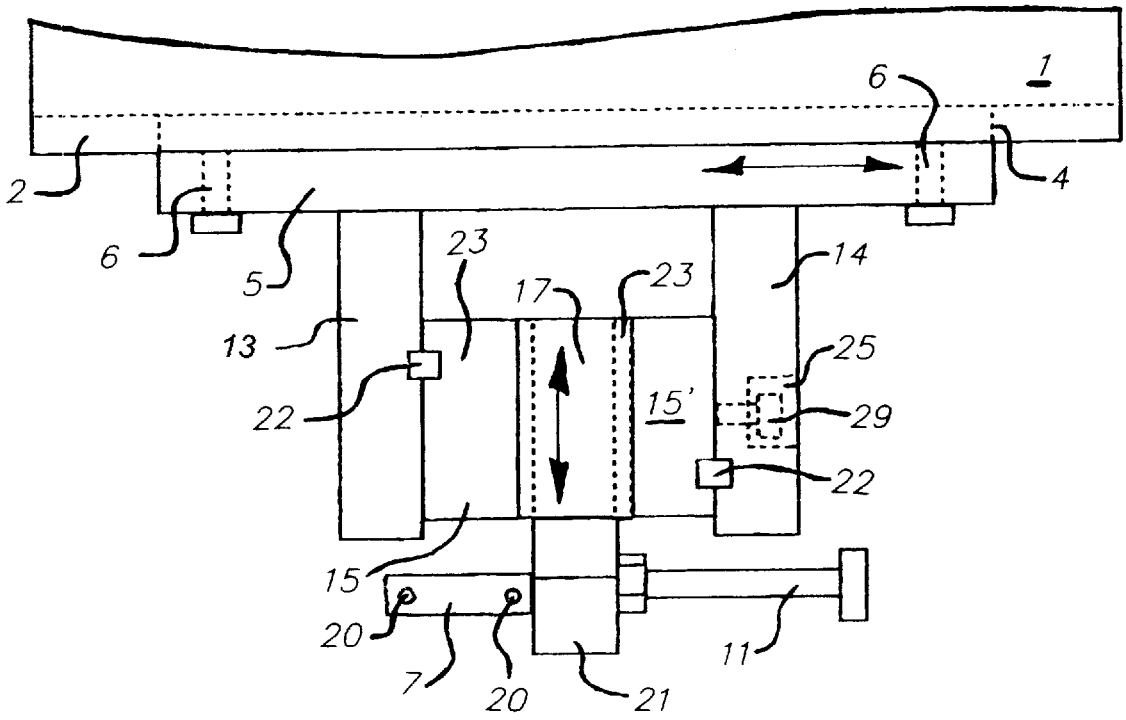
FIG. 2 shows a top plan view of the printing press frame adjusting mechanism according to FIG. 1.

The plate 5 has first guiding components 4 (see FIG. 2) that engage with the first guides 2. The engagement of the first guiding components 4 of the plate 5 with the first guides 2 makes it possible to horizontally move the plate 5 along the frame 1. As a result, the first guiding components 4 for engaging with the first guides 2 of the frame 1 can slide back and forth in the frame 1 in the direction x substantially horizontal. The plate 5 is attached to the frame 1 by a first set screw 6 that is inserted through the plate 5 via the first tap hole 19.

Firmly connected with the plate 5 are a first side wall 13 and a second side wall 14, which are both perpendicular to the plate 5 and which preferably have recesses 25. The first side wall 13 and the second side wall 14 are connected at the underside via a floor plate 18. Two guides 22 are located on the inner surface of the first side wall 13 and on the inner surface of the second side wall 14. The second guides 22 of the first side wall 13 and the second side wall 14 engage with a second guiding component 15 and a second guiding component 15'. The second guiding components can slide in direction y substantially vertical.

A third guiding component 17 is located between the second guiding component 15 and the second guiding component 15'. Attached to the third component 17 are third guides 23 which engage with the second guiding component 15 on the one side and the second guiding component 15' on the other side, which make it possible to slide the third guiding component 17 back and forth between the second guiding component 15 and the second guiding component 15' in the direction z toward and away from the frame 1 (in a direction transverse to a substantially horizontal plane through the frame).

A fastening component 21 is attached to the outer end face of the third guiding component 17. The fastening component 21 has a hole for the insertion of a dowel 11. On one side, the fastening component 21 has a support 7 for a printing module, the support 7 having two holes 20 on its top side, and on the other side, the dowel 11. The support 7 is connected with the fastening component 21 by a bushing/pin connection, whereby a bushing or a recess, which is also known as a pit, is located on the fastening component 21, into which the pin on the fastening component is inserted and which forms a secure connection between the fastening component 21 and the support 7. second set screw 9 and an adjusting screw 10 extend through the A floor plate 18 via tap holes. The second adjusting screw 10 is inserted as seen from below behind the floor plate 18 in a thread on the underside of the second guiding component 15. As would be seen from below, the thread of the adjusting screw 10 is inserted behind the floor plate 18 into a thread in the underside of the second guiding component 15'. Located in a recess 25 of the second side wall 14 is a third set screw 29, which extends through the second side wall 14 and which is inserted in the side wall that is turned away from the second side wall 14 of the second guiding component 15'.

The operation of the invention is as follows. If it is determined that the nip or compression zone of the printing press is incorrectly positioned, i.e., the printing drum is misaligned with the conveyor belt, the device ensures the mechanical adjustment of the nip with respect to the conveyor belt. Such misalignments occur, for example, when the frame is moved from its idle position during maintenance.

A deviation in the approximately horizontal direction lengthwise to the frame indicated by the x arrows is corrected by pulling or pushing on the dowel 11 in the x direction. To this end, the dowel 11 is removed by pulling it out of its secured position, whereby a pin of the dowel 11 is pulled out of The fastening component 21. Then the device is moved to the left or the right according to FIG. 1 by pulling or pushing in the x direction, against which the frame 1 remains in a fixed position. The pulling or pushing causes the first guiding component 4 of the plate 5 to move in the first guides 2 with the plate 5 moving in the respective horizontal direction lengthwise to the frame 1. The second guiding components 15, 15' and the third guiding component 17 remain fixed in their position during this process. The pulling or pressing of the dowel 11 thus causes a shifting of the printing module connected with the support 7 by a clamping device.

Once the device has been moved in the desired manner in the direction x, the dowel 11 is locked in a secured position, and the printing module is positioned in a fixed horizontal alignment with the frame 1. Since the frame 1 remains in a fixed position and is not moved, while the support 7 supporting the printing module is moved, the alignment of the printing module with respect to the to the frame 1 is altered and corrected. The device is moved in the direction z in a similar manner as described above. The third set screw 29 is loosened for this purpose, i.e., the bearing pressure of the third set screw 29 is reduced laterally to the second guiding component 15' by the second side wall 14. Pushing or pulling the dowel 11 in the direction z moves the third guiding component 17, which is connected with the dowel 11 by a fastening component 21, transverse to the horizontal plane through the frame 1. During this process, the third guiding component 17 slides relative to the third guides 23, which protrude from the second guiding component 15 and from the second guiding component 15'. The third guiding component 17 has recesses for this purpose, which, engage the third guides 23, similar to the manner in which the second guides 22 engage the second guiding components 15, 15'. In this manner, the printing module connected with the support 7 can be moved on both sides in the direction z. Once the device has been moved in the desired direction z, the third set screw 29 is securely tightened, i.e. the bearing pressure of the third set screw 29 on the second guiding component 15' is increased and the adjusted position in the direction z is set.

The printing module is now located in a fixed alignment with the frame 1. Both of the adjustments of the device in the direction x and in the direction z described above are only exemplary; further possibilities of moving the third guiding component 17 and the plate 5 with the first guiding component 4 are conceivable, particularly adjustments by micrometer screws. However, tests have shown that the sensitivity of the above-mentioned manual adjustments for the targeted registerability of printing presses, in which the printing module is manually adjusted with respect to the frame 1, is sufficient.

In conclusion, the adjustment of the device in the direction y is described. To this end, the second set screw 9 is loosened, which is inserted in the second guiding component 15 in the idle position. This makes it possible to move the device in the direction y substantially vertically relative to the frame 1. By turning the set screw 10, which is inserted into a thread of the second guiding component 15', the second guiding component 15' together with the second guiding component 15 and the third guiding component 17 are moved upward, whereby the second guiding components 15, 15' slide along to the second guides 22 and the third guiding component 17 is fastened to the second guiding components 15, 15' and moves with them. The adjusting screw 10 with the corresponding tapped hole in the second guiding component 15' makes it possible to adjust the device in the direction y in the micrometer range. The fastening component 21 is, as mentioned, connected with the third guiding component 17, so that the printing module is moved substantially vertically up or down in the direction y by the support 7 at the fastening component 21. Following the precise adjustment of the position in the direction y in the micrometer range, the second set screw 9 is securely tightened in such a way that it is inserted in the second guiding component 15, and thus locks the second guiding component 15' and the third guiding component 17 into position. By this setting, the device and the printing module are set in the direction y.

The invention has been described in detail with particular reference to certain preferred embodiments thereof, but it will be understood that variations and modifications can be effected within the spirit and scope of the invention.

PARTS LIST

1 Frame
2 First guides
3 Rollers
4 First guiding component
5 Plate
6 First set screw
7 Support
9 Second set screw
10 Adjusting screw
11 Dowel
13 First side wall
14 Second side wall
15 Second guiding component

15' Second guiding component
17 Third guiding component
18 Floor plate
19 First tap holes
20 Second tap holes
21 Fastening component
22 Second guides
23 Third guides
25 Recess
29 Third set screw

What is claimed is:

1. Device for adjusting a frame (1) of a printing press carrying a conveyor belt with respect to printing modules, said device comprising:

at least a first guide (2) on said frame (1), a plate (5) supported by said first guide (2) on said frame (1) for movement in the substantially horizontal direction x lengthwise to the frame (1), said plate (5) including a first guiding component (4) slidable in said first guide (2) for adjusting said frame (1) relative to a printing module in the direction x, two walls (13, 14) attached perpendicularly to the plate (5), and parallel to each other, two guides (22) respectively associated with said two walls (13, 14) to enable two movable guiding components (15, 15') to move in the vertical direction y with respect to said frame (1), third guides (23) on said two guiding components (15, 15') and, a third guiding component (17) between said two guiding components (15, 15'), said third guiding component (17), movable in said third guides (23) in the direction z transverse to a substantially horizontal plane of the frame (1).

2. Device according to claim 1, further including a dowel (11) connected to said third guiding component (17) for moving the device in the horizontal direction x and in the direction of z transverse to a substantially horizontal plane of the frame (1).

3. Device according to claim 1, further including at least a first set screw (6) for locking said plate (5) in the direction x to the frame (1), a second set screw (9) for locking said plate (5) in a particular position with respect to the vertical direction y to the frame (1), and a third set screw (29) for locking said plate (5) in the direction z.

* * * * *